US009181608B2

(12) United States Patent
Yamakawa et al.

(10) Patent No.: US 9,181,608 B2
(45) **Date of Patent: *Nov. 10, 2015**

(54) MAGNESIUM ALLOY SHEET

(75) Inventors: Masahiro Yamakawa, Osaka (JP); Takayasu Sugihara, Osaka (JP); Osamu Mizuno, Itami (JP); Kohji Inokuchi, Osaka (JP); Mitsutaka Tsubokura, Itami (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 589 days.

This patent is subject to a terminal disclaimer.

(21) Appl. No.: 13/577,269

(22) PCT Filed: Jan. 25, 2011

(86) PCT No.: PCT/JP2011/051256

§ 371 (c)(1), (2), (4) Date: Aug. 6, 2012

(87) PCT Pub. No.: WO2011/096294

PCT Pub. Date: Aug. 11, 2011

(65) Prior Publication Data

US 2012/0321881 A1 Dec. 20, 2012

(30) Foreign Application Priority Data

Feb. 8, 2010 (JP) ..... 2010-025467
Jan. 11, 2011 (JP) ..... 2011-003276

(51) Int. Cl.
*C22C 23/02* (2006.01)
*C22F 1/06* (2006.01)

(52) U.S. Cl.
CPC . *C22C 23/02* (2013.01); *C22F 1/06* (2013.01); *Y10T 428/258* (2015.01)

(58) Field of Classification Search
None
See application file for complete search history.

(56) References Cited

U.S. PATENT DOCUMENTS

| | | | | |
|---|---|---|---|---|
| 4,668,347 | A * | 5/1987 | Habermann et al. | 205/50 |
| 6,139,651 | A | 10/2000 | Bronfin et al. | |
| 6,143,097 | A | 11/2000 | Fujita et al. | |
| 8,906,294 | B2 * | 12/2014 | Mizuno et al. | 420/407 |

FOREIGN PATENT DOCUMENTS

| | | | |
|---|---|---|---|
| CN | 1438347 | A | 8/2003 |
| CN | 101512028 | A | 8/2009 |
| EP | 0665299 | A1 | 8/1995 |
| JP | 05-078775 | A | 3/1993 |
| JP | 05-117798 | A | 5/1993 |
| JP | H07224344 | A | 8/1995 |
| JP | H0924338 | A | 1/1997 |
| JP | 2002-332534 | A | 11/2002 |
| JP | 2004-060048 | A | 2/2004 |
| JP | 2004-107743 | A | 4/2004 |
| JP | 2006-291327 | A | 10/2006 |
| JP | 2006291327 | A | 10/2006 |
| JP | 2007-098470 | A | 4/2007 |
| JP | 2007327115 | A | 12/2007 |
| JP | 2008-106337 | A | 5/2008 |
| JP | 2008106337 | A | 5/2008 |
| JP | 2009-120877 | A | 6/2009 |
| RU | 2213796 | C2 | 10/2003 |
| WO | 2008029497 | A1 | 3/2008 |
| WO | 2009001516 | A1 | 12/2008 |

OTHER PUBLICATIONS

Notification of Second Office Action for corresponding Chinese Patent Application No. 201180008745.7 dated Mar. 18, 2014, 17 pages.
International Search Report for PCT Application No. PCT/JP2011/051256 dated May 10, 2011, pp. 1-2.
Chinese Office Action in corresponding Patent Application No. 201180008745.7, issued on Jul. 26, 2013, 15 pgs.
International Search Report for PCT/JP2010/071849 dated Mar. 8, 2011, pp. 1.
Chinese Office Action in corresponding Patent Application No. 201080056199.X, issued on May 6, 2013, 14 pages.
English translation with Russian Decision on Grant for Corresponding Patent Application No. 2012129180 mailed Oct. 10, 2013, pp. 1-11.
US Office Action for related U.S. Appl. No. 13/515,169 dated Jul. 12, 2013, 6 pages.
US Office Action for related U.S. Appl. No. 13/515,169 dated Apr. 4, 2013, 6 pages.

* cited by examiner

*Primary Examiner* — Sheeba Ahmed
(74) *Attorney, Agent, or Firm* — Ditthavong & Steiner, P.C.

(57) ABSTRACT

A magnesium alloy sheet is made of a magnesium alloy containing Al. Particles of an intermetallic compound containing at least one of Al and Mg are present in the sheet in a dispersed state. The sheet includes an oxide film which extends substantially over the surface of the sheet and which has a uniform thickness. The average size of the particles of the intermetallic compound is 0.5 μm or less. The percentage of the total area of the particles is 11% or less. Therefore, the magnesium alloy sheet is excellent corrosion resistance. A magnesium alloy structural member is provided.

9 Claims, 7 Drawing Sheets

(I) SAMPLE NO. 1

(II) SAMPLE NO. 100

MAGNESIUM ALLOY SHEET

TECHNICAL FIELD

The present invention relates to magnesium alloy sheets suitable for materials for various structural members such as housings for electric/electronic devices and also relates to magnesium alloy structural members made from the sheets. The present invention particularly relates to a magnesium alloy sheet excellent in corrosion resistance.

BACKGROUND ART

Magnesium alloys containing magnesium and various additive elements have been used for constituent materials for various structural members such as housings for portable electric/electronic devices including cellular phones and laptop computers and parts of automobiles.

For structural members made of magnesium alloys, a cast material (an AZ91 alloy specified in American Society for Testing and Materials (ASTM) standards) produced by a die casting process or a thixomolding process is in the mainstream. In recent years, structural members obtained by press-forming sheets made of wrought magnesium alloys represented by an AZ31 alloy specified in the ASTM standards have been being used. Patent Literature 1 proposes a magnesium alloy sheet which is made of an alloy corresponding to the AZ91 alloy specified in the ASTM standards and which is excellent in press formability.

Since magnesium is an active metal, surfaces of the structural members and magnesium alloy sheets used to manufacture the structural members are usually subjected to anticorrosion treatment including anodic oxidation treatment and chemical conversion treatment.

CITATION LIST

Patent Literature

PTL 1: Japanese Unexamined Patent Application Publication No. 2007-098470

SUMMARY OF INVENTION

Technical Problem

In magnesium alloys, such as the above-mentioned AZ31 alloy and AZ91 alloy, containing Al, the more the content of Al is, the more excellent the corrosion resistance tends to be. For example, the AZ91 alloy is excellent in corrosion resistance among magnesium alloys. However, even structural members (mainly cast materials) made of the AZ91 alloy require the anticorrosion treatment. When being not anticorrosion-treated, even cast materials made of the AZ91 alloy are corroded during corrosion testing including salt spray testing and saltwater immersion testing as described below. Even in the case of performing coating in addition to the anticorrosion treatment for the purpose of increasing corrosion resistance, when a magnesium alloy is exposed because a flaw is caused by dropping or the like or a coating is stripped off due to excessive use, the exposed portion is corroded. Thus, magnesium alloy sheets for making magnesium alloy structural members need to be excellent in corrosion resistance.

It is an object of the present invention to provide a magnesium alloy sheet excellent in corrosion resistance. Furthermore, it is another object of the present invention to provide a magnesium alloy structural member which is made from the magnesium alloy sheet and which is excellent in corrosion resistance.

Solution to Problem

The inventors have carried out saltwater corrosion testing to investigate magnesium alloy sheets containing Al for corrosion resistance and have obtained a finding that a sheet excellent in corrosion resistance has an oxide film, formed on the surface of the sheet, uniform in thickness after the testing. The sheet having the oxide film uniform in thickness after the testing also has an oxide film uniform in thickness before the testing. The inventors have investigated the structure of such a sheet and have obtained a finding that fine intermetallic compounds are dispersed. Furthermore, the inventors have obtained a finding that a magnesium alloy sheet which has an oxide film formed on the sheet surface, uniform in thickness as described above and which has a structure in which fine intermetallic compounds are present in a specific range is durable in use even if the magnesium alloy sheet is not subjected to anticorrosion treatment which is conventionally believed to be essential. The present invention is based on the findings.

A magnesium alloy sheet according to the present invention is made of a magnesium alloy containing Al. Particles of an intermetallic compound containing at least one of Al and Mg are present in the sheet in a dispersed state and the sheet includes an oxide film which extends substantially over the surface of the sheet and which has a uniform thickness. The average size of the particles of the intermetallic compound is 0.5 μm or less. In a cross section of the sheet, the percentage of the total area of the particles of the intermetallic compound is more than 0% to 11%.

Since the magnesium alloy sheet according to the present invention includes the oxide film, which extends substantially over the surface of the sheet and has a uniform thickness, the magnesium alloy sheet is excellent in corrosion resistance because the magnesium alloy sheet can effectively suppress that corrosion factors such as air and water come into contact with the magnesium alloy. Furthermore, fine particles made of an intermetallic compound superior in corrosion resistance to a matrix (matrix phase) of the magnesium alloy are present in a surface region of the magnesium alloy sheet at least and therefore the magnesium alloy sheet according to the present invention is excellent in corrosion resistance. In particular, when the intermetallic compound is present in a specific range (area fraction), Al can sufficiently form a solid solution in the matrix phase; hence, it can be suppressed that the cast sheet of the matrix phase is deteriorated by the conversion of Al into the intermetallic compound. Thus, the magnesium alloy sheet according to the present invention can be used even if the magnesium alloy sheet is subjected to anticorrosion treatment such as chemical conversion treatment.

Since the fine particles of the intermetallic compound are present in the magnesium alloy sheet according to the present invention in a dispersed state, it is expected that the rigidity of the sheet can be increased by enhancing the dispersion of the particles and/or strength due to solid solution hardening by Al can be maintained as described above. Thus, the magnesium alloy sheet according to the present invention is unlikely to be dented by impact and is excellent in rigidity and impact resistance.

Furthermore, the magnesium alloy sheet according to the present invention has substantially no defects, such as coarse intermetallic compounds or coarse pores, acting as origins of cracks during plastic forming and therefore is excellent in plastic formability. Thus, the magnesium alloy sheet according to the present invention can be suitably used for base materials for plastic forming materials. In addition, a magnesium alloy structural member according to the present invention is obtained by subjecting the magnesium alloy sheet according to the present invention and is excellent in corrosion resistance even if the magnesium alloy structural member is not subjected to anticorrosion treatment. Incidentally, the structure of the magnesium alloy sheet according to the present invention is mostly maintained in a portion (typically a flat portion) of the magnesium alloy sheet according to the present invention, the portion having little deformation due to plastic deformation.

Advantageous Effects of Invention

A magnesium alloy sheet according to the present invention and a magnesium alloy structural member according to the present invention are excellent in corrosion resistance.

DESCRIPTION OF EMBODIMENTS

Figure 1:
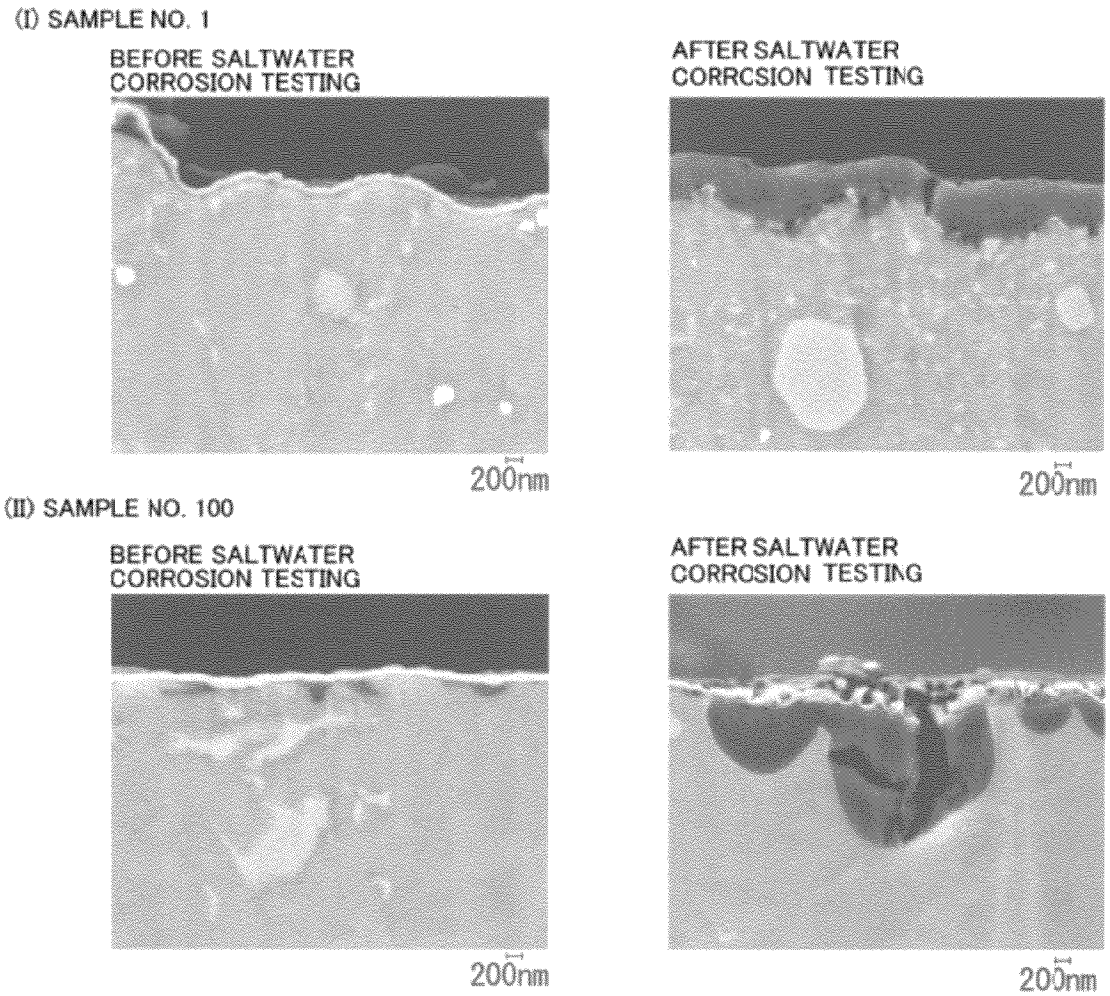
FIG. 1 includes micrographs (20,000× magnification) taken near surfaces of magnesium alloy sheets before or after saltwater corrosion testing, a (I) portion of FIG. 1 shows Sample No. 1, and a (II) portion of FIG. 1 shows Sample No. 100.

The present invention is described below in detail.

[Magnesium Alloy Sheet]

(Composition)

A magnesium alloy for making a magnesium alloy sheet or magnesium alloy structural member according to the present invention includes those having various compositions containing Mg and additive elements (the remainder being Mg and impurities). In the present invention, the magnesium alloy is particularly an Mg—Al alloy containing an additive element and at least Al. An increase in Al content tends to lead to excellent corrosion resistance and excellent mechanical properties such as strength and plastic deformation resistance. Therefore, the content of Al is preferably 4.5% by mass or more, more preferably 7% by mass or more, and further more preferably more than 7.5% by mass. However, when the content of Al exceeds 12% by mass, a reduction in plastic formability is caused; hence, the upper limit thereof is preferably 12% by mass and more preferably 11% by mass.

An additive element other than Al is one or more selected from Zn, Mn, Si, Ca, Sr, Y, Cu, Ag, Zr, Ce, and rare-earth elements (excluding Y and Ce). When these elements are contained, the sum of the contents thereof is preferably 0.01% to 10% by mass and more preferably 0.1% to 5% by mass. Examples of the Mg—Al alloy include, for example, AZ alloys (Mg—Al—Zn alloys containing 0.2% to 1.5% by mass Zn), AM alloys (Mg—Al—Mn alloys containing 0.15% to 0.5% by mass Mn), Mg—Al-RE (rare-earth element) alloys, AX alloys (Mg—Al—Ca alloys containing 0.2% to 6.0% by mass Ca), and AJ alloys (Mg—Al—Sr alloys containing 0.2% to 7.0% by mass Sr) as specified in ASTM standards. In particular, an Mg—Al alloy containing 8.3% to 9.5% by mass Al and 0.5% to 1.5% by mass Zn, typically an AZ91 alloy, has excellent corrosion resistance and therefore is preferred. Impurities are, for example, Fe, Ni, Cu, and the like.

(Structure)

<Intermetallic Compound>

<<Composition>>

The magnesium alloy has a structure in which fine particles of an intermetallic compound are dispersed in a matrix phase in a specific range. Examples of the intermetallic compound include compounds, such as $Mg_{17}Al_{12}$, containing Mg and Al and compounds, such as Al(MnFe), containing Al.

<<Average Particle Size and Area Fraction>>

The term "fine" described above means that the average particle size is 0.5 μm or less. The term "dispersed structure" described above means that 11% by area or less of particles of the intermetallic compound are present in total with 100% by area representing a cross section of the magnesium alloy sheet. When the area fraction is more than 0% by area, a sufficient amount of the intermetallic compound is present in the magnesium alloy sheet. Moreover, when the average particle size is 0.5 μm or less, the effect of increasing corrosion resistance due to the dispersion of the fine intermetallic compound is sufficiently achieved. When the average particle size is excessively large or the area fraction is excessively large, an excessive amount of the intermetallic compound is present or coarse particles with a size of 5 μm or more are present in the magnesium alloy sheet; hence, the amount of solute Al (the concentration of Al) in the matrix phase is reduced and a reduction in corrosion resistance is caused. Furthermore, when the intermetallic compound has coarse particles sparsely present in the matrix phase, the coarse particles and the matrix phase form local cells and corrosion such as pitting is likely to be caused. Furthermore, the coarse particles can be origins of cracks during plastic working or the like. Thus, the intermetallic compound preferably has particles which are as fine as possible and which are uniformly dispersed and more preferably has an average particle size of 0.3 μm or less. It is believed that the area fraction is preferably 8% by area or less.

<<Number>>

When the number of particles of the intermetallic compound in a cross section of the magnesium alloy sheet is 0.1 or more per square micrometer, the fine particles of the intermetallic compound are uniformly dispersed in the matrix phase and the magnesium alloy sheet is capable of having more excellent corrosion resistance. The number thereof is more preferably 0.3 or more per square micrometer. However, when the number of large particles of the intermetallic compound is excessively large, the concentration of Al in the matrix phase is reduced and a reduction in corrosion resistance is caused as described above. Therefore, grains of the intermetallic compound are preferably fine as described above.

<Pores>

A form in which pores present in the sheet have a maximum size of 5 μm or more is cited as a form of the magnesium alloy sheet according to the present invention. Cast defects called pores are likely to be present in cast materials. The pores can be eliminated or reduced in size by subjecting the cast materials having the pores to working such as rolling. However, the pores are present in the untreated cast materials without being eliminated. When coarse pores with a size of more than 5 μm are present and are particularly exposed at a surface of the magnesium alloy sheet, the coarse pores are likely to act as origins of cracks to cause a reduction in corrosion resistance. In contrast, the magnesium alloy sheet according to the present invention has little number of the coarse pores or substantially no coarse pores because the magnesium alloy sheet is a rolled sheet obtained by rolling a cast sheet. Therefore, the magnesium alloy sheet is unlikely to have reduced corrosion resistance due to the presence of the coarse pores but has excellent corrosion resistance. Since it is preferred that no pores are present, the lower limits of the number and maximum size of the pores are not set.

(Oxide Film)

The magnesium alloy sheet according to the present invention includes an oxide film which extends over substantially the whole of the surface thereof and which has a uniform thickness. This is one of features. Since the magnesium alloy is active, oxide films are formed on the surface thereof if the magnesium alloy is not anticorrosion-treated or coated. According to investigations made by the inventors, cast materials have such oxide films having a nonuniform thickness and are poor in corrosion resistance. Therefore, one of requirements for the magnesium alloy sheet, according to the present invention, excellent in corrosion resistance specifies that the oxide film, which has a uniform thickness, is formed. The term "substantially the whole of the surface" refers to a region which excludes a portion where the oxide film cannot be accurately confirmed because of measurement limitations of an inspection instrument or the like and which corresponds to 90% or more, particularly 95% or more, of the surface area of the magnesium alloy sheet. The oxide film is substantially made of magnesium oxides (including a hydroxide) (90% by mass or more) and may contain impurities such as Al.

In the present invention, the uniformity defined as the proportion $t_{max}/t_{min}$ is used as an index of uniform thickness, wherein $t_{max}$ is the maximum thickness of the oxide film, which is present on the surface of the sheet, and $t_{min}$ is the minimum thickness thereof. Herein, oxide films formed by saltwater corrosion testing correspond to those produced by accelerating oxide films by natural oxidation. Thus, in the magnesium alloy sheet, according to the present invention, including the oxide film uniform in thickness, a thick oxide film with a uniform thickness is produced on the surface of the sheet even after saltwater corrosion testing; hence, the thickness of the oxide film can be readily measured and the uniformity thereof can be readily determined after saltwater corrosion testing. Therefore, it is proposed that the uniformity is used after saltwater corrosion testing. The uniformity is preferably 30 or less and most preferably 1.

(Corrosion Reaction Resistance)

The following form is cited as a form of the magnesium alloy sheet according to the present invention: a form in which corrosion reaction resistance due to alternating-current impedance after subjecting the sheet to saltwater corrosion testing is greater than corrosion reaction resistance due to alternating-current impedance before subjecting the sheet to saltwater corrosion testing. According to investigations made by the inventors, some of magnesium alloy sheets excellent in corrosion resistance have increased corrosion reaction resistance after saltwater corrosion testing as compared with those before saltwater corrosion testing. That is, the inventors have obtained an amazing finding that magnesium alloy sheets having enhanced corrosion resistance are present even after saltwater corrosion testing.

The reason for above is not clear but is probably as described below. Since the magnesium alloy is active as described above, oxide films are formed the surfaces of samples while the samples are in contact with a corrosive solution (a test solution) during saltwater corrosion testing. At this time, the oxide film is formed on the magnesium alloy sheet according to the present invention so as to have a uniform thickness as described above. Since the oxide film, which is excellent in corrosion resistance, is formed so as to have a uniform thickness as described above and functions as an anticorrosion layer, it is believed that corrosion reaction resistance is increased and corrosion resistance is enhanced after saltwater corrosion testing.

Furthermore, the inventors have studied the magnesium alloy sheets having increased corrosion reaction resistance after saltwater corrosion testing (that is, corrosion resistance is enhanced even after saltwater corrosion testing). As a result, the inventors have obtained a finding below. The oxide film is substantially made of such magnesium oxides as described above. The detailed analysis of the surfaces of the magnesium alloy sheets after saltwater corrosion testing has shown that corrosion layers formed on the surfaces thereof each have a region of the oxide film that contains large amounts of magnesium oxides and a high-Al concentration region which has a high Al concentration and which is rich in Al. It is believed that, for example, the high-Al concentration region is layered between the oxide film region and an inner region of each sheet that is not affected by corrosion like the oxide film region. It is believed that the high-Al concentration region suppresses the progress of corrosion and contributes the increase of corrosion reaction resistance, that is, the further enhancement of corrosion resistance.

The high-Al concentration region is a region which has an Al concentration higher than the Al concentration of an inner region (that is, a matrix (matrix phase) of the magnesium alloy, hereinafter simply referred to as "inner region" in some cases) of the magnesium alloy sheet that is not affected by corrosion. That is, in each corrosion layer, the high-Al concentration region has a relatively lower Mg concentration and a higher Al- to Mg concentration ratio [Al concentration (atomic percent)/Mg concentration (atomic percent)] as compared to the inner region. The form of Al present in the high-Al concentration region is unclear in detail but is probably a hydroxide or an oxide and is different from the state of Al present in the inner region (a solid solution in the matrix phase or an intermetallic compound such as $Mg_{17}Al_{12}$ or Al(MnFe)). When the Al concentration or Mg concentration of the inner region is measured, the central proximity in a thickness direction of the sheet or, for example, a range that is 100 μm or more deep from the surface of the sheet in the thickness (depth) direction of the sheet may be measured. The detailed mechanism of producing the high-Al concentration region is described below.

(Form)

The magnesium alloy sheet according to the present invention is typically in a form in which the thickness is globally uniform. In addition, the following forms are cited: various forms, such as a form in which portions having partly different thicknesses are formed by rolling using a mill roll having a recessed groove around the circumference of the roll and a form in which a through-hole is formed by machining, depending on various types of working or treatment performed in manufacturing steps. The type, thickness, and size (area) of the sheet can be appropriately selected depending on desired applications. In particular, when the maximum thickness is 2.0 mm or less, 1.5 mm or less, or particularly 1 mm or less, the sheet can be suitably used as a material for thin, light-weight structural members (typically housings).

As a form of the magnesium alloy sheet according to the present invention, a form in which none of both surfaces of the sheet is anticorrosion-treated can be cited. According to this configuration, anticorrosion treatment conventionally believed to be essential can be eliminated and therefore the production efficiency of the magnesium alloy sheet and a magnesium alloy structural member using the sheet can be increased. Furthermore, as a form of the magnesium alloy sheet according to the present invention, a form in which none of both surfaces of the sheet is anticorrosion-treated and in which one surface of the sheet has a coating layer can be cited. According to this form, the presence of the coating layer on one surface thereof enables the enhancement of the corrosion resistance of the magnesium alloy sheet, the coloring thereof, the application of a pattern thereto, and the like; hence, the commercial value thereof can be increased.

Naturally, the following form can be cited as a form of the magnesium alloy sheet according to the present invention: a form in which both surfaces of the sheet are subjected to anticorrosion treatment such as chemical conversion treatment and a form in which the sheet has a coating layer in addition to anticorrosion treatment. In this case, in addition to the inherent corrosion resistance of the magnesium alloy sheet, anticorrosion treatment enhances the corrosion resistance thereof to allow the magnesium alloy sheet to have extremely excellent corrosion resistance.

[Magnesium Alloy Structural Member]

The magnesium alloy structural member according to the present invention is obtained in such a manner that the magnesium alloy sheet according to the present invention is subjected to various types of plastic working including pressing, forging, and bending. The shape or size thereof is not particularly limited. The following members are cited: for example, a cross-sectionally ]-shaped housing including a top portion (a bottom portion) and a sidewall portion vertically extending from the outer edge of the top portion, a cross-sectionally ]-shaped frame, a cross-sectionally L-shaped frame, a capped cylinder including a disk-shaped top portion and a cylindrical sidewall portion, and the like. The top portions may each have a boss combined therewith or connected thereto; a hole extending between the front and back thereof; a groove recessed in a thickness direction thereof; a stepped portion; and a portion, formed by cutting, having locally different thicknesses.

[Manufacturing Method]

The magnesium alloy sheet according to the present invention can be manufactured by a manufacturing method including, for example, steps below.

Preparation step: a step of preparing a cast sheet, made of a magnesium alloy containing Al, produced by a continuous casting process.

Solution treatment step: a step of solution-treating the cast sheet at a temperature of 350° C. or higher to produce a solid-solution sheet.

Rolling step: a step of hot-rolling the solid-solution sheet to manufacture a rolled sheet.

In particular, in a step subsequent to the solution treatment step, the total time to hold a base sheet (typically the rolled sheet) that is a workpiece within a temperature range from 150° C. to 300° C. is 1 hour to 12 hours and the thermal history of the base sheet is controlled such that the base sheet is not heated to a temperature of more than 300° C.

The manufacturing method can further include a correction step of hot-correcting the rolled sheet. In the correction step, the rolled sheet is corrected in such a state that the rolled sheet is heated to a temperature of 100° C. to 300° C. In particular, the time to hold the rolled sheet within a temperature range from 150° C. to 300° C. in the correction step is included in the above-mentioned total time.

The inventors have investigated methods in which no coarse particles are produced but a certain number of fine particles are produced by controlling the particle size and amount of the intermetallic compound. As a result, the inventors have obtained a finding that a magnesium alloy sheet having the above-mentioned specific structure is in such a manner that manufacturing conditions are controlled such that the total time to hold a base material made of a magnesium alloy at a specific temperature is within a specific range during manufacturing steps subsequent to casting, particularly subsequent to solution treatment, until a final product. Therefore, the above-mentioned method is proposed as an example of a method for manufacturing the magnesium alloy sheet, according to the present invention, excellent in corrosion resistance. The intermetallic compound can be precipitated and the amount thereof can be controlled within a specific range in such a manner that the time to hold the base material made of the magnesium alloy within a temperature range (150° C. to 300° C.) in which the intermetallic compound is likely to be precipitated is controlled within a specific range during manufacturing steps subsequent to the solution treatment step and the base material is not heated to a temperature of more than 300° C. subsequently to solution treatment. Since the time to hold the base material within the above specific temperature range is controlled, the excessive growth of the intermetallic compound can be suppressed and a structure containing fine precipitates dispersed therein can be obtained.

Each step is described below in detail.

(Preparation Step)

The cast sheet is preferably one produced by a continuous casting process such as a twin-roll process or particularly a casting process disclosed in the pamphlet of International Publication No. 2006/003899. The continuous casting process enables rapid solidification; therefore can reduce oxides, segregation, and the like; and can suppress the production of coarse precipitates with a size of more than 10 μm. Thus, cast sheets excellent in rollability are obtained. The thickness of the cast sheet is not particularly limited. Since segregation is likely to occur when the thickness thereof is excessively large, the thickness thereof is preferably 10 mm or less and more preferably 5 mm or less.

(Solution Treatment Step)

The cast sheet is solution-treated, whereby the composition thereof is homogenized and elements such as Al are formed into solid solutions, thereby producing the solid-solution sheet. In the solution treatment, the holding temperature is preferably 350° C. or higher and particularly preferably 380° C. to 420° C. and the holding time is preferably 60 minutes to 2,400 minutes (1 hour to 40 hours). It is preferred that the more the content of Al is, the longer the holding time is. In a cooling step after the elapse of the holding time, if the cooling rate is increased by forced cooling such as water cooling or air blast cooling, the precipitation of coarse precipitates can be suppressed, which is preferred. Al can be formed into solid solutions in the magnesium alloy by performing the solution treatment as described above.

(Rolling Step)

Before the solid-solution sheet is rolled, a base material (the solid-solution sheet or a rolled sheet to be finish-rolled) is heated, whereby the plastic formability (rollability) can be enhanced. The heating of the base material to higher than 300° C. enhances the plastic formability and therefore the base material is readily rolled. However, the reduction of corrosion resistance is caused by the excessive production or coarsening of the intermetallic compound (precipitates) as described above, the sticking of the base material is caused, or grains of the base material are coarsened and therefore a sheet obtained by rolling has reduced mechanical properties. Therefore, in the rolling step, the heating temperature of the base material is 300° C. or lower. In particular, the heating temperature of the base material is preferably 150° C. to 280° C. By performing rolling several times (multipath), a desired sheet thickness can be achieved, the average grain size of the base material is reduced (for example, 10 μm or less and preferably 5 μm or less), and plastic formability including rollability and press formability can be enhanced. Rolling may be performed under such known conditions that, for example, not only the base material but also mill rolls are heated and controlled rolling disclosed in Patent Literature 1 and the like are used in combination.

In the case of performing multipath rolling, intermediate heat treatment may be performed between paths as far as the holding time within a temperature range from 150° C. to 300° C. is included in the total time. The intermediate heat treatment can remove or reduce strain, residual stress, and texture introduced in the base material, which is a workpiece, by plastic forming (mainly rolling) prior to the intermediate heat treatment and can prevent inadvertent cracking, distortion, and/or deformation during rolling subsequent to the intermediate heat treatment, whereby rolling is more smoothly performed. In the case of performing multipath rolling, the heating temperature of the base material is 300° C. or lower. The preferred heating temperature thereof is 250° C. to 280° C.

(Correction Step)

The rolled sheet obtained in the rolling step may be subjected to finish heat treatment (finish annealing) as disclosed in Patent Literature 1. The rolled sheet is preferably hot-corrected as described above without performing finish heat treatment or subsequently to finish heat treatment, because plastic formability such as press formability is excellent. Correcting is performed using a roll leveler described in the pamphlet of International Publication No. 2009/001516 in such a manner that the rolled sheet is heated to a temperature of 100° C. to 300° C., preferably 150° C. to 280° C. In the case of subjecting the rolled sheet hot-corrected as described above to plastic forming such as press forming, dynamic recrystallization occurs during plastic forming and therefore plastic formability is excellent.

In the case of performing finish heat treatment, strain caused by rolling can be relieved. Conditions for finish heat treatment are, for example, a base material-heating temperature of 100° C. to 300° C. and a heating time of 5 minutes to 60 minutes. The heating temperature may be 300° C. to 340° C. as disclosed in Patent Literature 1. In order to suppress the growth of the intermetallic compound as much as possible as described above, the heating time is preferably short and is, for example, less than 30 minutes.

(Total Time to Hold Base Material within Specific Range)

It has not been sufficiently investigated how much time needs to hold the base material within a temperature range from 150° C. to 300° C. during steps subsequent to solution treatment until a final product. On the other hand, the time to hold the base material within a temperature range in which the intermetallic compound is likely to be produced or grown as described above is controlled within a specific range, whereby the magnesium alloy sheet, which has a structure in which a specific amount of the fine intermetallic compound is present in a dispersed state, according to the present invention is obtained.

When the total time to hold the base material within a temperature range from 150° C. to 300° C. is less than 1 hour, the intermetallic compound is not sufficiently precipitated. When the total time is more than 12 hours or the base material is rolled with the base material heated to 300° C. or higher, a structure in which a coarse intermetallic compound with an average particle size of 1 μm or more is present or a structure in which the intermetallic compound is excessively present at more than 11% by area is obtained. The degree of working in each path in the rolling step, the total degree of working in the rolling step, conditions for intermediate or finish heat treatment, correcting conditions, and the like are preferably controlled such that the temperature range is 150° C. to 280° C. and the total time is 1 hour to 6 hours. The total time is preferably adjusted depending on the content of Al because the more the content of Al is, the more the intermetallic compound is likely to be precipitated.

Typical forms of the magnesium alloy sheet obtained by the manufacturing method are the rolled sheet and the corrected sheet.

(Other Steps)

The rolled sheet or a treated sheet obtained by subjecting the rolled sheet to the finish heat treatment and/or correcting is subjected to plastic forming such as press forming, whereby the magnesium alloy structural member according to the present invention is obtained. If the plastic forming is performed within a temperature range from 200° C. to 300° C., the plastic formability of the base material can be increased and plastic forming is readily performed. The time to hold the base material at 200° C. to 300° C. during plastic forming is very short and is, for example, 60 seconds or less in the case of press forming. It is believed that a failure such as the coarsening of the intermetallic compound as described above is not substantially caused.

By performing heat treatment subsequently to the plastic forming, strain and residual stress introduced by plastic forming can be relieved and mechanical properties can be enhanced. Conditions for the heat treatment are a heating temperature of 100° C. to 300° C. and a heating time of about 5 minutes to 60 minutes. In the heat treatment, the holding time in a temperature range from 150° C. to 300° C. is preferably included in the total time.

Furthermore, after the plastic forming, the coating layer can be provided as described above for the purpose of the enhancement of corrosion resistance, mechanical protection, decoration (an increase in commercial value), and the like.

Embodiments of the present invention are described below. In descriptions of figures, the same elements are denoted by the same reference numerals and will not be not redundantly described. Dimensional proportions in the figures do not necessarily agree with those in descriptions.

Test Example 1

Magnesium alloy sheets were prepared under various conditions and the metallographic structure, surface condition, and corrosion resistance of each sheet were investigated.

In this test, Sample Nos. 1 to 6 made from the magnesium alloy sheets as described below and a commercially available cast material (an AZ91 alloy, a 3 mm thickness sheet) were prepared. The cast material was wet-polished under substantially the same conditions as those for polishing Sample Nos. 1 to 6, whereby a polished sheet was prepared. The polished sheet was used as Sample No. 100.

The following sheets were prepared: a plurality of cast sheets (a thickness of 4 mm), made of a magnesium alloy having a composition (Mg, 9.0% Al, 1.0% Zn, and 0.15% to 0.5% Mn (on a mass basis)) corresponding to that of an AZ91 alloy, obtained by a twin-roll continuous casting process. The obtained cast sheets were solution-treated at 400° C. for 24 hours. Each solution-treated solid-solution sheet was rolled several times under rolling conditions shown in Table I, whereby a rolled sheet with a thickness of 0.6 mm was obtained.

For Sample Nos. 1, 2, and 4 to 6, corrected sheets were prepared in such a manner that the obtained rolled sheets were hot-corrected with the rolled sheets heated to temperatures shown in Table I. For Sample No. 3, a corrected sheet was prepared in such a manner that after one of the obtained rolled sheets was heat-treated at 320° C. for 15 minutes, this heat-treated sheet was hot-corrected with the heat-treated sheet heated to a temperature shown in Table I.

The hot correcting is performed using a roll leveler including a furnace capable of heating a base sheet (herein, a rolled sheet or a heat-treated sheet) and a roll section including a plurality of rolls for continuously applying bending (strain) to the heated base sheet. The roll section includes the rolls, which are alternately arranged to be vertically opposite each other. In the roll leveler, the base sheet is transferred to the roll section with the base sheet heated in the furnace and the rolls apply bending to the base sheet in series while the base sheet is passing between the rolls vertically arranged in the roll section.

For Sample Nos. 1 to 5, cast sheets with a predetermined length were prepared and were subjected to solution treatment, rolling, (heat treatment), and then correcting, whereby sheets were obtained. For Sample No. 6, an elongated cast sheet was prepared and was coiled, was solution-treated, was rolled with the elongated cast sheet repeatedly coiled and uncoiled, and was further corrected, whereby a coil was obtained.

Each obtained corrected sheet (a sheet or a coil) was further subjected to wet belt polishing using a #600 polishing belt and a surface of the corrected sheet smoothed by polishing, whereby a polished sheet was prepared. The polished sheets were used as Sample Nos. 1 to 6. For Sample Nos. 1 to 6, the total time to hold each sheet within a temperature range from 150° C. to 300° C. was adjusted to 1 to 12 hours and the sheet was not heated to higher than 300° C. except that the rolled sheet of Sample No. 3 was heat-treated.

TABLE I

| Sample No. | 1 | 2 | 3 | 4 | 5 | 6 |
|---|---|---|---|---|---|---|
| Rolling | Rough 6 | Rough 5 + finish 2 | Rough 5 + finish 2 | Rough 5 + finish 2 | Rough 4 + finish 2 | Rough 6 |
| Heat treatment | Not performed | Not performed | Performed | Not performed | Not performed | Not performed |
| Hot correcting | 250° C. | 250° C. | 250° C. | 200° C. | 200° C. | 200° C. |

* The term "Rough n" means that rough rolling is performed through n paths. The term "Rough n + finish m" means that after rough rolling is performed through n paths, finish rolling is performed through m paths.
* Rough rolling conditions are a degree of working (rolling reduction) of 5%/path to 40%/path, a base sheet-heating temperature of 250° C. to 280° C., and a rolling temperature of 100° C. to 250° C.
* Finish rolling conditions are a degree of working (rolling reduction) of 5%/path to 40%/path, a base sheet-heating temperature of 210° C. to 240° C., and a rolling temperature of 150° C. to 180° C.

Figure 2:
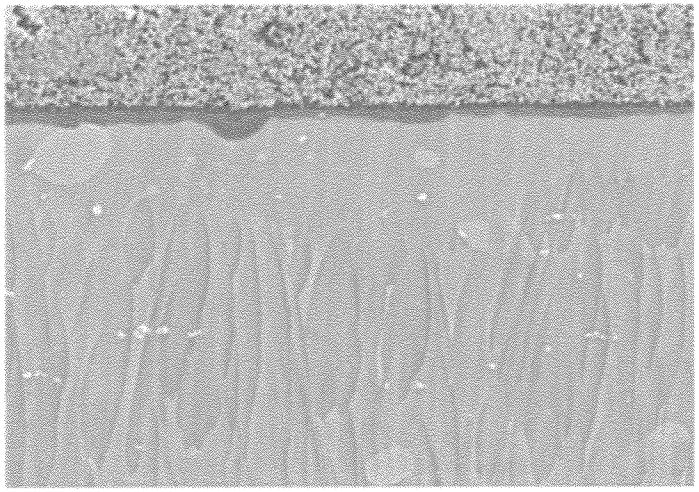
FIG. 2 includes micrographs (5,000× magnification) taken near surfaces of magnesium alloy sheets before or after saltwater corrosion testing, a (I) portion of FIG. 2 shows Sample No. 1, and a (II) portion of FIG. 2 shows Sample No. 100.
Figure 2:
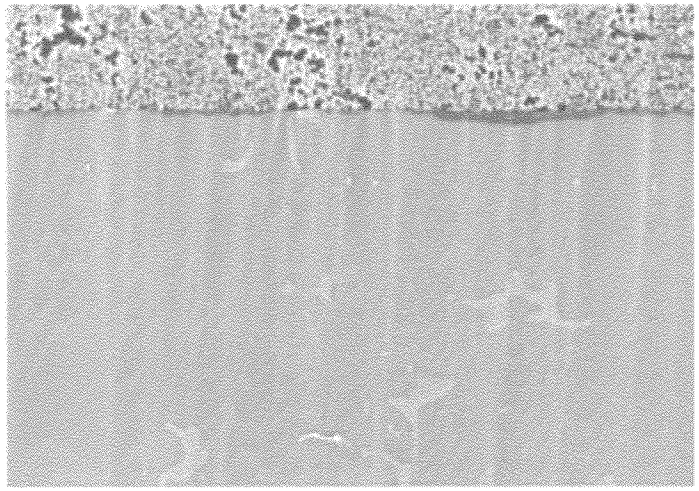
Figure 3:
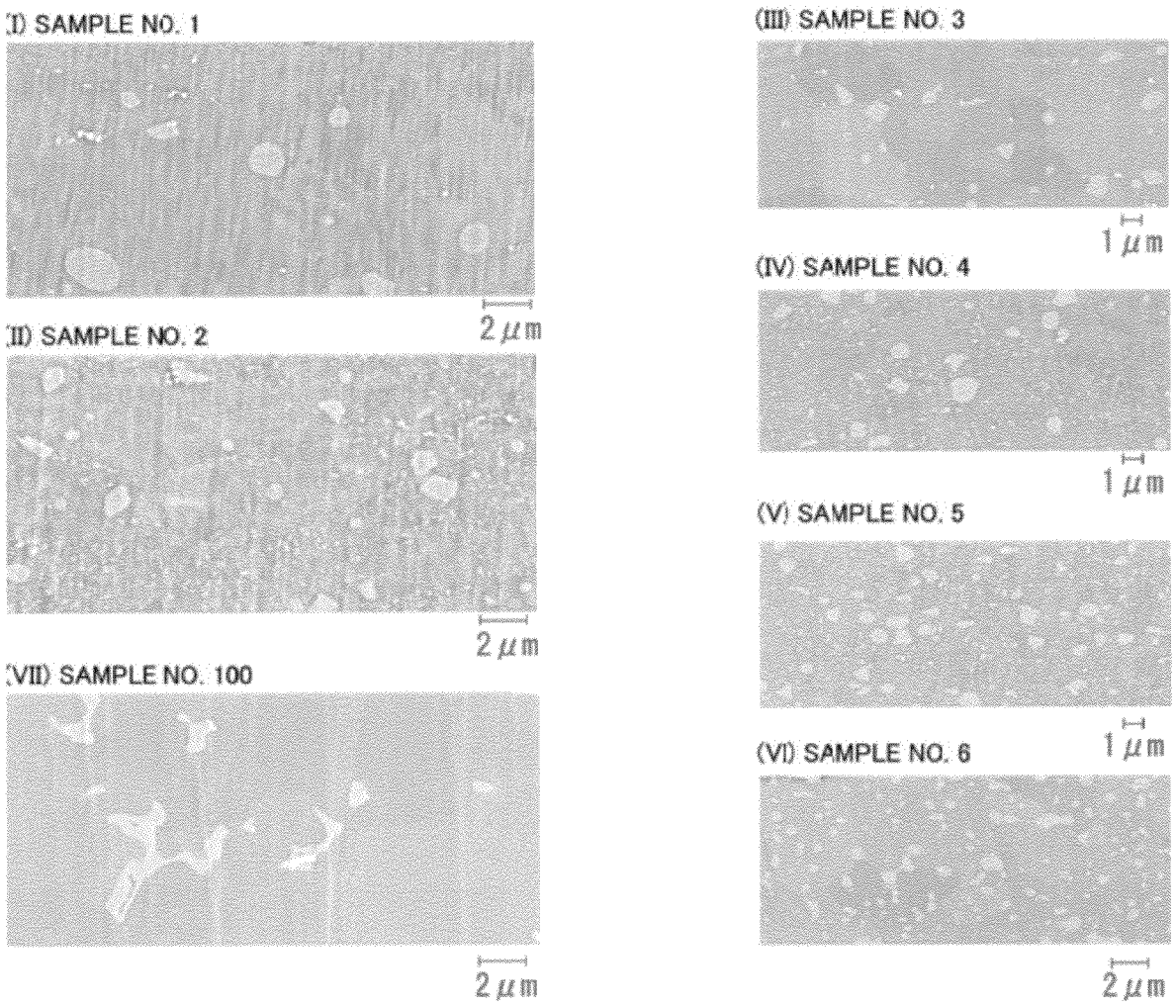
FIG. 3 includes micrographs (5,000× magnification) of magnesium alloy sheets, (I) to (VI) portions of FIG. 3 show Sample Nos. 1 to 6, and a (VII) portion of FIG. 3 shows Sample No. 100.
Figure 4:
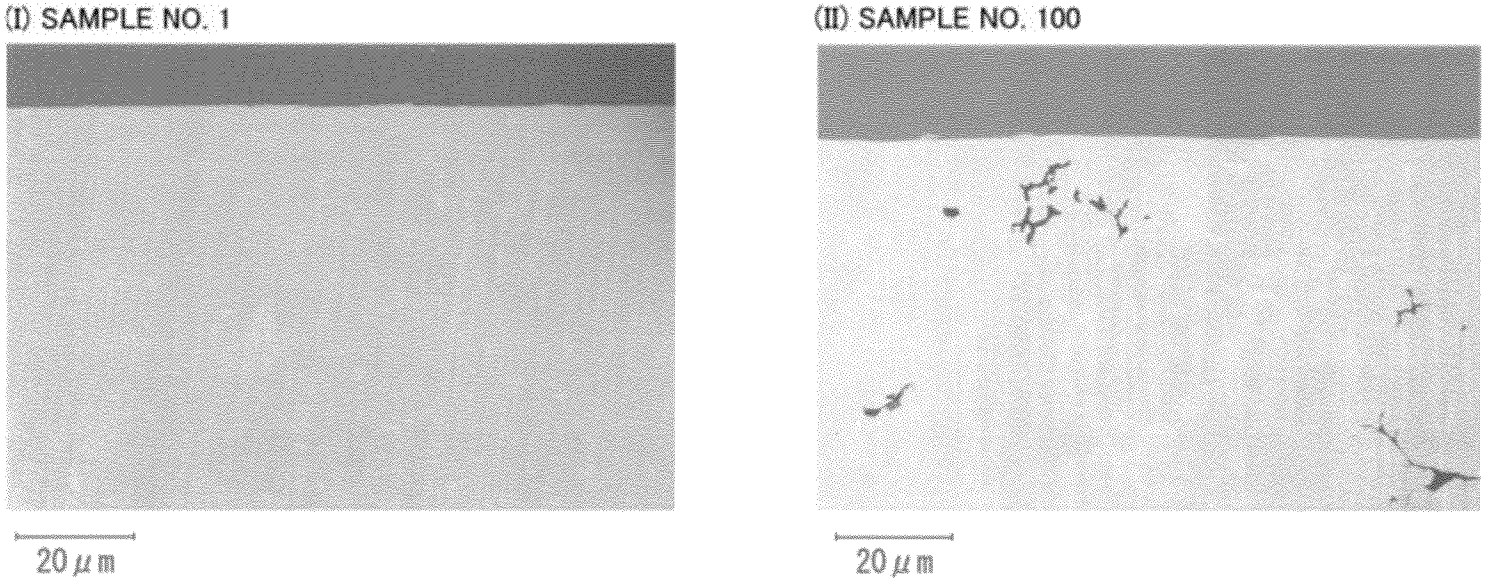
FIG. 4 includes micrographs (1,000× magnification) of magnesium alloy sheets, a (I) portion of FIG. 4 shows Sample No. 1, and a (II) portion of FIG. 4 shows Sample No. 100.

Obtained Sample Nos. 1 to 6 and Sample No. 100 for comparison were arbitrarily cut in a thickness direction, whereby cross sections were taken. The cross sections were observed with a scanning electron microscope (SEM). A (I) portion of FIG. 1 shows observed images (20,000× magnification) of Sample No. 1. A (II) portion of FIG. 1 shows observed images (20,000× magnification) of Sample No. 100. The left photograph of each of the (I) and (II) portions of FIG. 1 is one taken before saltwater corrosion testing and the right photograph thereof is one taken after saltwater corrosion testing as described below. FIG. 2 shows observed images taken after saltwater corrosion testing as described below. A (I) portion of FIG. 2 shows an observed image (5,000× magnification) of Sample No. 1. A (II) portion of FIG. 2 shows an observed image (5,000× magnification) of Sample No. 100. (I) to (VI) portions of FIG. 3 show observed images (5,000× magnification) of Sample Nos. 1 to 6. A (VII) portion of FIG. 3 shows an observed image (5,000× magnification) of Sample No. 100. A (I) portion of FIG. 4 shows an observed image (1,000× magnification) of Sample No. 1 and an observed image (1,000× magnification) of Sample No. 100. The following particles are those of an intermetallic compound: light gray particles and white particles in FIGS. 1 to 3 and light gray and white particles (including oddly shaped particles) in the (II) portion of FIG. 1, the (II) portion of FIG. 2, and the (VII) portion of FIG. 3. Black oddly shaped particles in a (II) portion of FIG. 4 correspond to pores.

Each of Sample Nos. 1 to 6 and 100 was measured for the average size (μm) of particles of the intermetallic compound, the percentage (%) of the total area of the particles of the intermetallic compound, the number (particles/$\mu m^2$) of the particles of the intermetallic compound, and the maximum size (μm) of pores. The results are shown in Table II. Furthermore, the average distance (μm) between the neighboring particles of the intermetallic compound and the circularity coefficient of the particles of the intermetallic compound were measured. The results are also shown in Table II.

In addition, obtained Sample Nos. 1 to 6 and Sample No. 100 for comparison were subjected to saltwater corrosion testing and measured for corrosion reaction resistance (Ω) before and after the testing, corrosion weight loss ($\mu g/cm^2$) by the testing, and Mg elution amount ($\mu g/cm^2$) by the testing and the uniformity of oxide films was measured after the testing. The results are shown in Table III.

The average size of particles of the intermetallic compound was measured as described below. For each sample, 5 cross sections are taken in a thickness direction and 3 fields of view (herein, 22.7 μm×17 μm regions) are arbitrarily taken from an observed image of each cross section. The equivalent circle diameter (the diameter of a circle with an area equivalent to the area of a particle) of each particle present in one of the observed fields of view is determined and the value "(sum of equivalent circle diameters)/(total number of particles)" obtained by dividing the sum of equivalent circle diameters by the number of the particles present in one of the observed fields of view is defined as the average particle size of the observed fields of view. For each sample, the average of the average particle sizes of 15 observed fields of view is shown in Table II.

The percentage of the total area of the particles of the intermetallic compound was measured as described below. Observed fields of view are taken as described above, the area of each of all the particles present in one of the observed fields of view is measured, and the total area is calculated for each field of view. The value "(total area of particles)/(area of field of view)" obtained by dividing the total area by the area (herein, 385.9 $\mu m^2$) of one of the observed fields of view is defined as the area fraction of this observed field of view. For each sample, the average of the area fractions of 15 observed fields of view is shown in Table II.

The number of particles of the intermetallic compound was measured as described below. Observed fields of view are taken as described above, the number of all the particles present in one of the observed fields of view is measured, and the total number is calculated for each field of view. The value "(total number of particles)/(area of field of view)" obtained by dividing the total number by the area (herein, 385.9 $\mu m^2$) of one of the observed fields of view is defined as the number of this observed field of view. For each sample, the average of the numbers of 15 observed fields of view is shown in Table II.

The average distance between particles of the intermetallic compound was measured as described below. Observed fields of view are taken as described above, the average area "(total area of particles)/(total number of particles)" of one of the particles is determined for each field of view from the total area and total number of all the particles present in one of the observed fields of view, and the value obtained by dividing the total area of all the particles by the average area is defined as the number of the particles present in this observed field of view. The number of the particles in this observed field of view is divided by the area (herein, 385.9 $\mu m^2$) of this observed field of view, whereby the number of the particles per unit area is determined. The square root of the number of the particles per unit area is defined as the number of the particles per unit distance and the reciprocal of the number of the particles per unit distance is defined as the average distance of this observed field of view. For each sample, the average of the average distances of 15 observed fields of view is shown in Table II.

The circularity coefficient of particles of the intermetallic compound was measured as described below. Observed fields of view are taken as described above, the area and perimeter of each particle present in one of the observed fields of view are measured, and circularity coefficient=$4\pi\times$area/(perimeter)$^2$ is calculated for each particle in this field of view, whereby the circularity coefficient of the particle is obtained. The average of the circularity coefficients of all the particles is defined as the circularity coefficient of this field of view. For each sample, the average of the circularity coefficients of 15 observed fields of view is shown in Table II.

The maximum size of pores was measured as described below. Observed fields of view are taken as described above and pores present in one of the observed fields of view are visually checked. When the pores are present, the maximum size and length (the maximum length of a line connecting two arbitrary points on a pore) of each pore are determined and the maximum of these values is defined as the maximum size of the pores in this observed field of view. For each sample, the average of the maximum sizes of the pores in 15 observed fields of view is shown in Table II.

Parameters, such as the average particle size, relating to particles of the intermetallic compound, the maximum size of pores, and the uniformity of oxide films below can be readily calculated using a commercially available image processer. The particles can be analyzed for composition with an energy dispersive x-ray spectrometer (EDS) and were intermetallic compound, such as $Mg_{17}Al_{12}$ or Al(MnFe), containing Al and/or Mg. The presence of the intermetallic compound can be judged in such a manner that the composition and the structure are analyzed by X-ray diffraction. The composition of a substance present on the surface of a magnesium alloy sheet can be analyzed by applying EDS analysis to a cross section of a sample. For Sample Nos. 1 to 6 and 100, an oxide film is present on the surface of each magnesium alloy sheet. It could be confirmed that the oxide film was principally made of magnesium oxides (including a hydroxide).

The corrosion weight loss was measured by performing neutral salt spray testing in accordance with JIS H 8502 (1999) as saltwater corrosion testing as described below. Specimens are prepared from the polished sheets of Sample Nos. 1 to 6 and 100. After the mass (initial value) of each specimen is measured, an unnecessary portion of the specimen is masked such that a test surface with a predetermined size is exposed on the specimen. The masked specimen is charged into a corrosion tester and is vertically placed so as to incline to the bottom surface of the tester at a predetermined angle (herein, the angle formed by the tester bottom surface and the specimen is 70° to 80°). The specimen is maintained for a predetermined time (herein, 96 hours) in such a state that a test solution (a 5 mass percent aqueous solution of NaCl with a temperature of 35° C.±2° C.) is sprayed on the specimen. After the elapse of a predetermined time, the specimen is taken out of the corrosion tester, masking is removed, and corrosion products formed on the specimen are then removed by chromic acid dissolution in accordance with Reference Table I of JIS Z 2371 (2000). The mass of the specimen free from the corrosion products is measured. The value obtained by dividing the difference between this mass and the initial value by the area of the test surface of the specimen is defined as the corrosion weight loss ($\mu g/cm^2$).

The Mg elution amount was measured by performing saltwater immersion testing as saltwater corrosion testing as described below. Specimens are prepared from the polished sheets of Sample Nos. 1 to 6 and 100. An unnecessary portion of each specimen is masked such that a test surface with a predetermined size is exposed on the specimen. The masked specimen is maintained for a predetermined time (herein, maintained for 96 hours at room temperature (25° C.±2° C.) under air conditioning) in such a state that the specimen is entirely immersed in a test solution (a 5 mass percent aqueous solution of NaCl, the amount of the solution being (A)×20 ml, the area (exposed area) of the test surface of the specimen being (A) $cm^2$). After the elapse of a predetermined time, the test solution is collected and the amount of Mg ions in the test solution is determined by inductively coupled plasma atomic emission spectrometry (ICP-AES). The value obtained by dividing the amount of the Mg ions by the area of the test surface of the specimen is defined as the Mg elution amount ($\mu g/cm^2$).

The corrosion reaction resistance was measured as described below. Specimens are prepared from the polished sheets of Sample Nos. 1 to 6 and 100. An unnecessary portion of each specimen is masked such that a test surface with a predetermined size and terminal-connecting portions are exposed on the specimen. Terminals are attached to the terminal-connecting portions and the specimen is entirely immersed in a test solution (a saturated aqueous solution containing (0.1% by mass NaCl) and $Mg(OH)_2$) together with a reference electrode and counter electrode below (room temperature (25° C.±2° C.) under air conditioning). The alternating current impedance of the specimen is measured under conditions below immediately after immersion.

Measurement apparatus: potentiostat/galvanostat+frequency response analyzer

The measurement apparatus can use a commercially available apparatus (for example, HZ-3000 manufactured by Hokuto Denko Corporation, FRA 5080 manufactured by NF Corporation, or the like).

Electrodes: three-electrode type, Reference electrode: Ag/AgCl, Counter electrode: Pt Measurement conditions: Current modulation: 10 $\mu A/cm^2$, Measurement frequency range: 10 kHz to 100 mHz Measurement results of the alternating current impedance are analyzed, whereby the corrosion reaction resistance is calculated. In particular, the impedance (0) measured at each frequency is plotted on a complex plane (a Nyquist diagram is prepared), and the diameter (=charge transfer resistance) of a semicircle observed in a high-frequency region is read. The charge transfer resistance is defined as the corrosion reaction resistance. The corrosion reaction resistance measured prior to the saltwater corrosion testing is defined as the initial corrosion reaction resistance (corrosion testing: 0 hours).

Similar terminals are attached to the specimen subjected to saltwater immersion testing as saltwater corrosion testing as described above, the alternating current impedance thereof is similarly measured, and the corrosion reaction resistance is read. The corrosion reaction resistance at that time is defined as the corrosion reaction resistance after corrosion testing (herein, after saltwater immersion testing for 96 hours).

The uniformity of oxide films was measured as described below. For the specimen subjected to saltwater immersion testing as described above, cross sections and observed fields of view are taken as described above, the thickness of an oxide film in one of the observed fields of view is measured, the maximum $t_{max}$ and minimum $t_{min}$ of the thickness are extracted for each field of view, and the uniformity $t_{max}/t_{min}$ is calculated. This uniformity is defined as the uniformity of this field of view. For each sample, the average of the uniformities of 15 observed fields of view is shown in Table III.

TABLE II

| Sample No. | 1 | 2 | 3 | 4 | 5 | 6 | 100 |
|---|---|---|---|---|---|---|---|
| Average particle size (μm) | 0.21 | 0.2 | 0.23 | 0.11 | 0.18 | 0.27 | 0.95 |
| Area fraction (%) | 3.46 | 6.12 | 6.66 | 6.44 | 7.47 | 10.59 | 4.58 |
| Number of particles (particles/$\mu m^2$) | 1.12 | 1.92 | 0.8 | 2.13 | 1.77 | 1.4 | 0.03 |
| Maximum size of pores (μm) | <1 | <1 | <1 | <1 | <1 | <1 | 23 |
| Average distance (μm) | 0.94 | 0.52 | 1.05 | 0.69 | 0.75 | 0.85 | 5.53 |
| Circularity coefficient | 1.05 | 1 | 0.93 | 0.95 | 0.91 | 0.86 | 0.74 |

As shown in Tables II and III, Sample Nos. 1 to 6 each include an oxide film globally uniform in thickness because the uniformity of the oxide film is 30 or less after saltwater corrosion testing. In contrast, Sample No. 100, which is made of a die-cast material, includes an oxide film which is significantly variable in thickness. Sample Nos. 1 to 6 have a very small corrosion weight loss and a small Mg elution amount as compared to Sample No. 100 and are excellent in corrosion resistance.

In each photograph in FIG. 1, a lower region principally shown in gray is a magnesium alloy, a blackish (dark) region located thereon is an oxide film, a white belt-like portion located on the oxide film is a protective layer provided for the purpose of cutting out a cross section, and an upper region principally shown in black is a background. In each photograph (taken subsequently to saltwater corrosion testing) in FIG. 2, a lower region is a magnesium alloy, an upper porous region is a protective layer provided for the purpose of cutting out a cross section, and a dark region present between the magnesium alloy and the protective layer is an oxide film.

As shown in the photograph, taken prior to saltwater corrosion testing, in FIG. 1, Sample No. 1, which is excellent in corrosion resistance, includes an oxide film which is uniform in thickness and which is formed over the surface of a magnesium alloy sheet before saltwater corrosion testing. In contrast, Sample No. 100, which is made of the die-cast material, includes no oxide film extending over the surface of a magnesium alloy sheet but oxide films locally present. The oxide films present in Sample No. 100 are formed so as to extend toward an inner portion of the magnesium alloy sheet.

Furthermore, as shown in FIGS. 1 and 2, Sample No. 1, which is excellent in corrosion resistance, includes an oxide film which is uniform in thickness and which is produced after saltwater corrosion testing. This shows that Sample Nos. 1 to 6 include oxide films which are uniform in thickness and which are produced with time and therefore probably have excellent corrosion resistance due to the presence of the oxide films. In contrast, Sample No. 100, which is made of the die-cast material, includes the oxide films, which are nonuniform in thickness before and after saltwater corrosion testing, and portions which are poor in corrosion resistance and which are corroded and has pits as shown in the (II) portion of FIG. 1. From the photographs in FIG. 1, it can be estimated that if an oxide film is formed substantially over the surface of a magnesium alloy sheet after saltwater corrosion testing so as to have a uniform thickness, an oxide film is uniformly present substantially over the surface of the magnesium alloy sheet even before saltwater corrosion testing. Thus, Sample Nos. 1 to 6 probably have excellent corrosion resistance because the oxide films are uniformly present substantially over the surfaces of the magnesium alloy sheets even before saltwater corrosion testing.

Furthermore, in Sample Nos. 1 to 6, which are excellent in corrosion resistance, fine round particles made of the intermetallic compound are present in a dispersed state as shown

TABLE III

| Sample No. | | 1 | 2 | 3 | 4 | 5 | 6 | 100 |
|---|---|---|---|---|---|---|---|---|
| Corrosion reaction resistance (Ω) | 0H | 1685.1 | 1160.5 | 1329.9 | 1316.8 | 1367.0 | 1198.8 | 1162.7 |
| | 96H | 5184.4 | 1641.8 | 3342.2 | 1272.2 | 742.1 | 408.4 | 676.1 |
| Corrosion weight loss ($\mu g/cm^2$) | | 176 | 232 | 173.4 | 402 | 628 | 625 | 2200 |
| Mg elution amount ($\mu g/cm^2$) | | 350 | 365 | 330.4 | 451 | 499.2 | 625.6 | 818.6 |
| Oxide film uniformity | | 5 | 8 | 6 | 8 | 10 | 20 | >30 |

in the (I) to (VI) portions of FIG. 3. In Sample No. 100, which is made of the die-cast material, large oddly shaped particles are sparsely present as shown in FIG. 3(VII). As shown in Table II, the intermetallic compound present in Sample Nos. 1 to 6 has an average particle size of 0.5 μm or less, is fine, and has a circularity coefficient close to 1; the distance between neighboring particles thereof is less than Sample No. 100, which is made of the die-cast material; and the area fraction is 11% by area or less. This supports that the intermetallic compound is uniformly dispersed in Sample Nos. 1 to 6.

Sample Nos. 1 to 6 have a structure in which the fine particles of the intermetallic compound are dispersed and which acts as a barrier against corrosion factors in addition to the presence of the oxide films, which have a uniform thickness, and therefore are probably excellent in corrosion resistance. In contrast, Sample No. 100, which is made of the die-cast material, consists of a structure in which the large intermetallic compound is sparsely present, has no barrier unlike Sample Nos. 1 to 6, and therefore is probably poor in corrosion resistance.

The following sample is present among Sample Nos. 1 to 6, which are excellent in corrosion resistance: a sample in which the corrosion reaction resistance due to alternating current impedance after saltwater corrosion testing is higher than that before the testing and in which the corrosion resistance is enhanced. The reason why a result that the corrosion resistance is excellent after saltwater corrosion testing is obtained as described above is probably that the oxide films are grown during corrosion testing to have a uniform thickness as described above, which is one of causes.

Furthermore, in Sample Nos. 1 to 6, which are excellent in corrosion resistance, substantially no pores are observed as shown in, for example, the photograph of Sample No. 1 in the (I) portion of FIG. 4. In contrast, in Sample No. 100, which is made of the die-cast material, a large number of large pores are present. Sample Nos. 1 to 6 are probably excellent in corrosion resistance because of the absence of large pores.

Test Example 2

The inventor further analyzed, in detail, a sample in which the corrosion reaction resistance after saltwater corrosion testing is higher than that before the testing and in which the corrosion resistance is enhanced, the sample being among Sample Nos. 1 to 6, which are excellent in corrosion resistance as described in Test Example 1.

Figure 5:
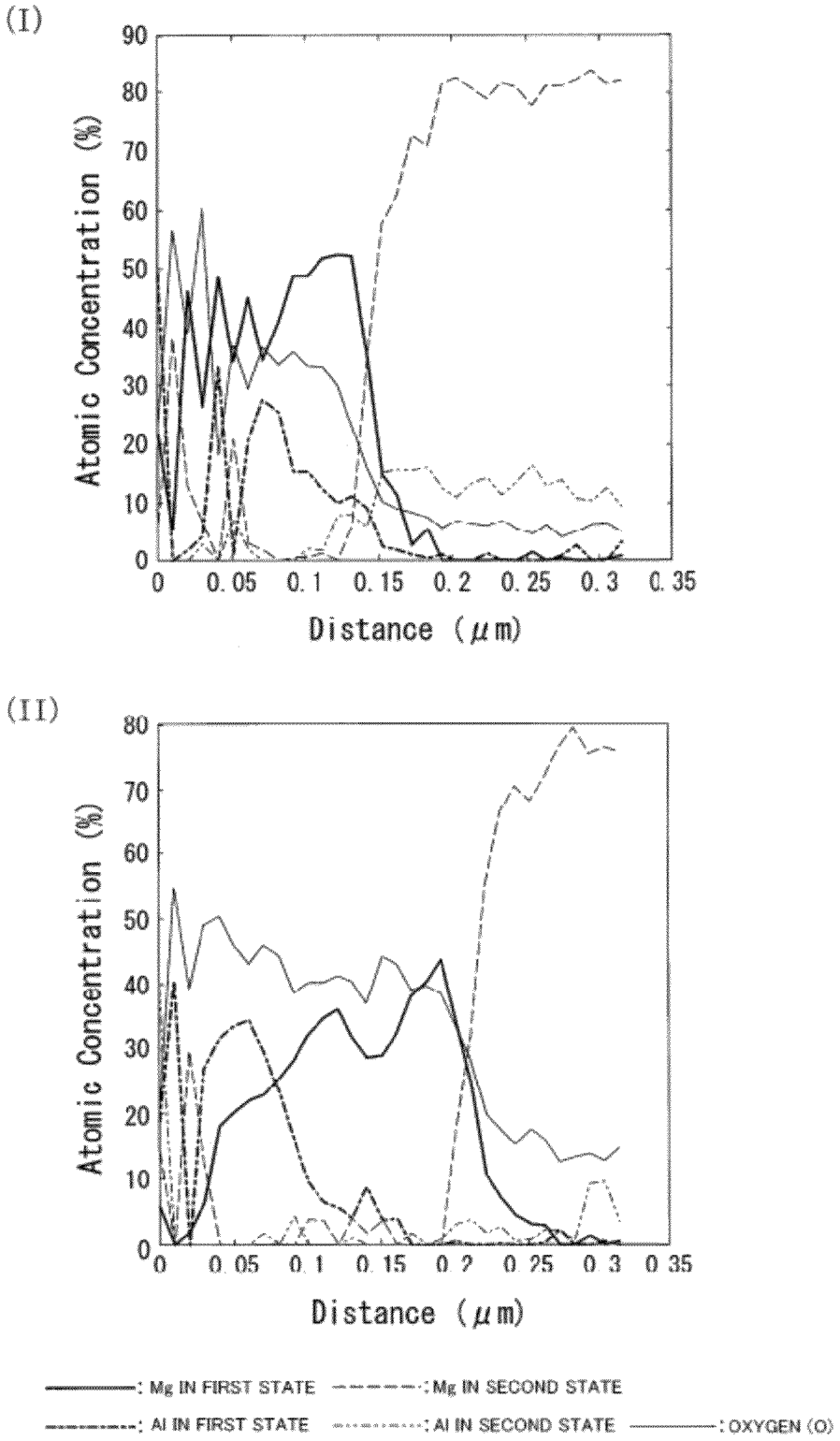
FIG. 5 shows results obtained by line-scanning a cross section of a specimen of Sample No. 3 before or after saltwater corrosion testing by AES, a (I) portion of FIG. 5 shows AES analysis results after saltwater immersion testing for 0.5 hour, and a (II) portion of FIG. 5 shows AES analysis results after saltwater immersion testing for 24 hours.
Figure 6:
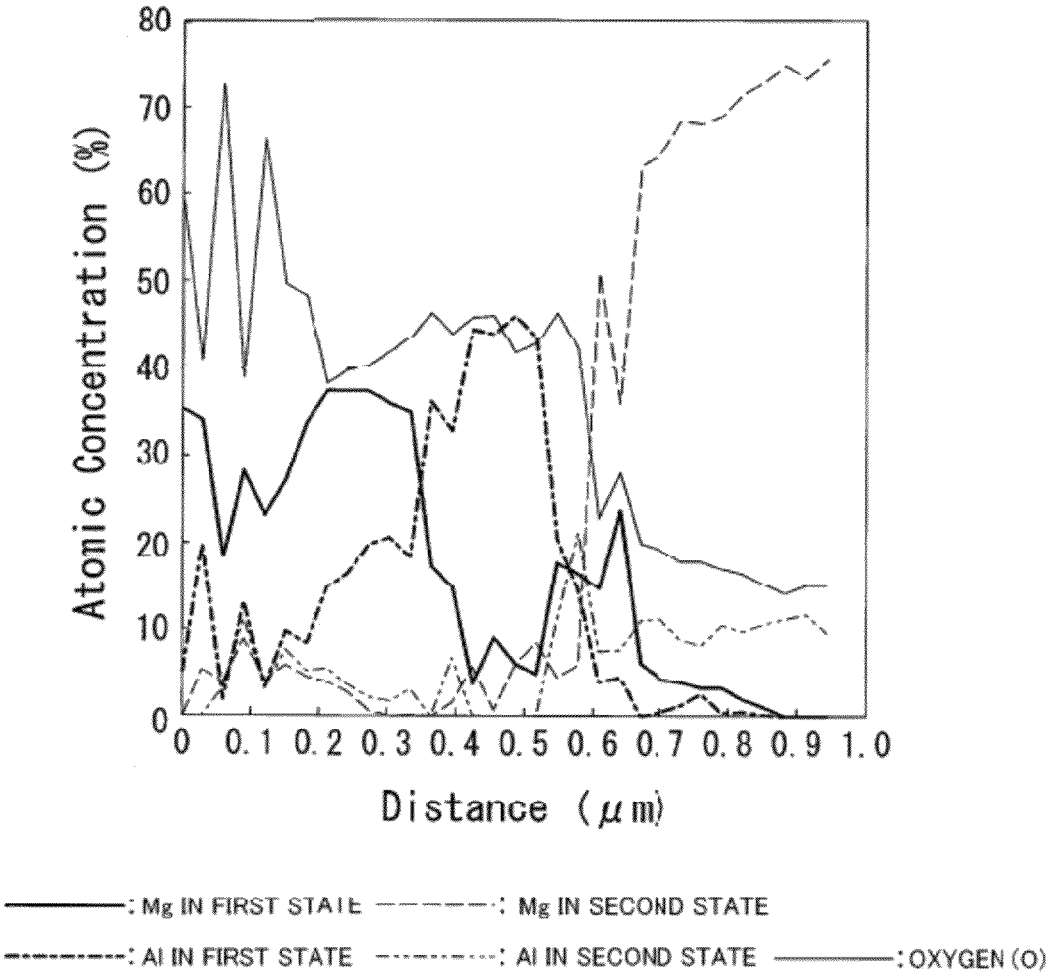
FIG. 6 shows results obtained by line-scanning a cross section of a specimen of Sample No. 3 after saltwater corrosion testing by AES and AES analysis results after saltwater immersion testing for 96 hours.

Specimens were prepared from Sample No. 3 described in Test Example 1. Saltwater immersion testing was applied to the specimens as saltwater corrosion testing. Saltwater immersion testing was performed in such a manner that the specimens were maintained (maintained at room temperature (25° C.±2° C.) under air conditioning) in such a state that the specimens were entirely immersed in a test solution (a 5 mass percent aqueous solution of NaCl). After saltwater immersion testing was performed for a predetermined time, the specimens were taken out of the test solution and a cross section of each specimen was analyzed for elemental composition by Auger electron spectroscopy (AES). The analysis by AES was performed in such a manner that the cross section of the specimen was exposed by cross-section polishing using an Ar ion beam and was line-scanned by AES in a thickness (depth) direction of a sheet from a surface of the sheet toward an inner region thereof. This enables the elemental composition analysis of a surface of the magnesium alloy sheet of Sample No. 3 after the elapse of a predetermined time since the start of testing. Results obtained by analyzing the specimens each subjected to saltwater immersion testing for 0.5 hour (30 minutes), 24 hours, or 96 hours by AES are shown in FIGS. 5 and 6. The AES analysis was performed in such a state that each specimen was inclined at 30°.

A (I) portion of FIG. 5 shows AES analysis results after saltwater immersion testing for 0.5 hour, a (II) portion of FIG. 5 shows AES analysis results after saltwater immersion testing for 24 hours, and FIG. 6 shows AES analysis results after saltwater immersion testing for 96 hours. In each of FIGS. 5 and 6, the abscissa represents the distance (depth) [μm] from a surface, the ordinate represents the atomic concentration [%], a solid line represents Mg in a first state, a thin broken line represents Mg in a second state, a dashed represents Al in a first state, a thin two-dot chain line represents Al in a second state, and a thin solid line represents oxygen (O). Since the AES analysis was performed in such a state that each specimen was inclined at 30°, the distance (depth) from an actual surface is the value obtained by multiplying a value on the abscissa by 1.15 (by $2/\sqrt{3}$). The term "Mg in a first state" as used herein refers to Mg present in the form of an hydroxide (for example, $Mg(OH)_2$) or an oxide (for example, MgO). The term "Mg in a second state" as used herein refers to Mg present in the form of a magnesium alloy (a matrix phase). On the other hand, the term "Al in a first state" as used herein refers to Al present in the form of an hydroxide (for example, $Al(OH)_2$) or an oxide (for example, $AlO_x$). The term "Al in a second state" as used herein refers to Al present in the form of a solid solution in a matrix phase or in the form of an intermetallic compound such as $Mg_{17}Al_{12}$. Such elements, compositions, or chemical bonds can be identified in such a manner that the energy of Auger electrons is measured by AES analysis.

From the (I) portion of FIG. 5, it is believed that an oxide film region in which the concentration of Mg in the first state is high and which is rich in Mg is present in a surface region (a corrosion layer; a range from a surface (0) to about 0.17 μm (0.15 μm on the abscissa)) of the specimen (the magnesium alloy sheet) subjected to saltwater immersion testing for 0.5 hour. Since the concentration of Mg in the first state is reduced and the concentration of Mg in the second state is increased at a depth of more than 0.17 μm (0.15 μm on the abscissa)) from the surface, this range is believed to be an inner region not affected by corrosion. On the other hand, it is not clearly recognized that a high-Al concentration region in which the concentration of Al in the first state is high and which is rich in Al is present in the surface region (the corrosion layer). Furthermore, it turns out that the concentration of Al in the first state in an inner region (a range about more than 0.17 μm (0.15 μm on the abscissa) deep from the surface) substantially agrees with the Al concentration of an AZ91 alloy.

From the (II) portion of FIG. 5, an oxide film region in which the concentration of Al in the first state is higher than the concentration of Mg in the first state and which is rich in Mg is not recognized in a surface region (a corrosion layer; a range from a surface (0) to about 0.12 μm (0.1 μm on the abscissa)) of the specimen (the magnesium alloy sheet) subjected to saltwater immersion testing for 24 hours. Since the concentration of Mg in the first state is reduced and the concentration of Mg in the second state is increased at a depth of more than 0.23 μm (0.2 μm on the abscissa)) from the surface, this range is believed to be an inner region. Since the concentration of Al in the first state in the surface region (the corrosion layer) is higher than the concentration of Al in the second state in an inner region (a range about more than 0.23 μm (0.2 μm on the abscissa) deep from the surface), a high-Al concentration region rich in Al is believed to be present in the surface region.

From FIG. 6, an oxide film region rich in Mg and a high-Al concentration region rich in Al are recognized in a surface region (a corrosion layer; a range from a surface (0) to about 0.69 μm (0.6 μm on the abscissa)) of the specimen (the magnesium alloy sheet) subjected to saltwater immersion testing for 96 hours from the surface side. In particular, in an outermost region (a range from a surface (0) to about 0.35 μm (0.3 μm on the abscissa)), an oxide film region in which the concentration of Mg in the first state is high and which is rich in Mg is believed to be present. In a region (a range from the surface to about 0.35-0.69 μm (0.3-0.6 μm on the abscissa)) inside the outermost region, a high-Al concentration region in which the concentration of Al in the first state is high and which is rich in Al is believed to be present. Since the concentration of Mg in the second state is increased at a depth of more than 0.69 μm (0.6 μm on the abscissa)) from the surface, this range is believed to be an inner region. That is, results obtained by analyzing this specimen by AES show that in this specimen, the oxide film regions and the high-Al concentration regions are formed in the corrosion layer formed on the surface.

Next, the inventors have studied a mechanism to produce a high-Al concentration region on the basis of the above analysis result as described below.

Figure 7:
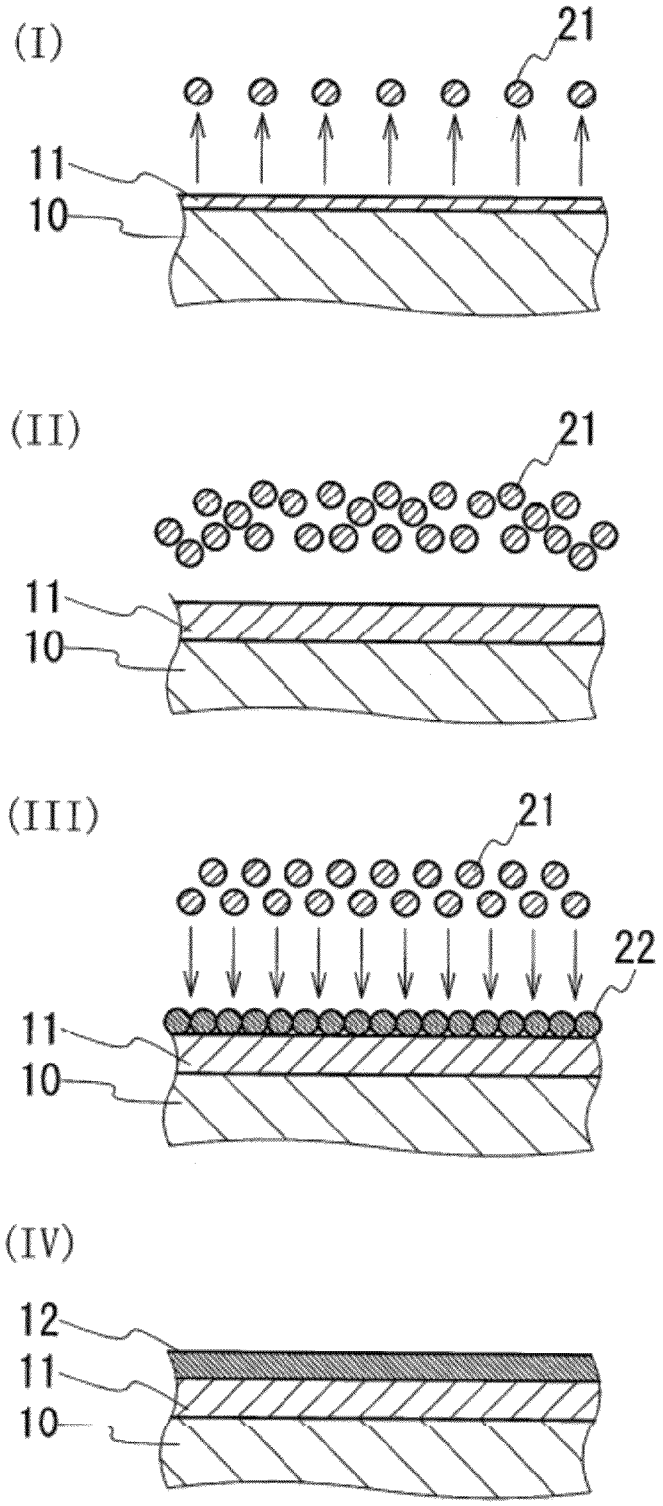
FIG. 7 is a schematic view illustrating the progression of corrosion of a magnesium alloy sheet containing Al during saltwater immersion testing.

FIG. 7 is a schematic view illustrating the progression of corrosion of a magnesium alloy sheet containing Al during saltwater immersion testing. At an early stage from the start of testing, Mg in an Mg—Al alloy matrix is eluted from a surface of the magnesium alloy sheet 10 into a test solution (an aqueous solution of NaCl) in the form of ions 21 ($Mg^{2+}$) (see a (I) portion of FIG. 7). Herein, Mg is believed to be predominantly eluted because Mg is higher in ionization tendency than Al. The concentration of Al is relatively increased at the surface of the magnesium alloy sheet 10 because Mg is eluted; hence, Al is concentrated with the progression of corrosion.

With the elapse of time from the start of testing, the amount of eluted Mg is increased, the concentration of the Mg ions 21 is increased near the surface of the sheet 10, and the pH is also increased (see a (II) portion of FIG. 7). In a region where Al is concentrated at the surface of the sheet 10, a portion of Al combines with a hydroxyl ion to form a hydroxide and a portion of the hydroxide reacts with oxygen in the test solution to form an oxide. This allows a high-Al concentration region 11 rich in Al to be produced on the surface of the sheet 10.

Furthermore, with the elapse of time, the pH is also increased near the surface of the sheet 10 and the Mg ions 21 are oversaturated; hence, the Mg ions 21 are precipitated on the surface of the sheet 10 (the surface of the high-Al concentration region 11) in the form of Mg oxides 22 (see a (III) portion of FIG. 7). In the test solution, the Mg oxides 22 are precipitated principally in the form of a hydroxide. The hydroxide is believed to be partially or completely converted into an oxide with the elapse of time because the hydroxide is exposed to air after testing.

The Mg oxides are finally precipitated on the surface of the sheet 10 (the surface of the high-Al concentration region 11), whereby an oxide film region 12 rich in Mg is produced (see (VI) of FIG. 7). Therefore, the oxide film region 12 of the Mg oxides and the high-Al concentration region 11 are produced in a corrosion layer formed on the surface. For example, the high-Al concentration region 11 is believed to be layered between the oxide film region 12 of the Mg oxides and a portion of the initial magnesium alloy sheet 10 (that is, an inner portion of the sheet that is not affected by corrosion) in some cases.

The high-Al concentration region 11, which is supposed to be effective in suppressing the progress of corrosion to a certain extent, is not any dense passive film and therefore is corroded with the elapse of time; hence, the oxide film region 12 of the Mg oxides is believed to be formed. This phenomenon can occur even in Al-containing magnesium alloy sheets which are not made of an AZ91 alloy, although differences in Al concentration may possibly be caused in high-Al concentration regions depending on differences in Al content between alloys. Furthermore, even in the case of a magnesium alloy sheet in which an oxide film uniform in thickness is formed substantially over the surface, it is estimated that a high-Al concentration region, as well as the oxide film, is formed so as to have a uniform thickness. That is, the high-Al concentration region is believed to meet the range (from 1 to 30) of the same uniformity as the uniformity of the oxide film.

The above-mentioned embodiments can be appropriately modified without departing from the scope of the present invention and are not limited to the above-mentioned configurations. For example, the composition of a magnesium alloy (particularly the content of Al), the thickness of a magnesium alloy sheet, manufacturing conditions, and the like can be appropriately varied.

INDUSTRIAL APPLICABILITY

A magnesium alloy structural member according to the present invention can be suitably used for structural members for various electric/electronic devices, particularly for housings for portable or small-size electric/electronic devices, and structural members used in various fields where high strength is desired. A magnesium alloy sheet according to the present invention can be suitably used for a material for the magnesium alloy structural member according to the present invention.

REFERENCE SIGNS LIST

10 magnesium alloy sheet (inner region)
11 high-Al concentration region
12 oxide film region
21 Mg ions
22 Mg oxides

The invention claimed is:

1. A magnesium alloy sheet made of a magnesium alloy containing Al, comprising:

particles of an intermetallic compound containing at least one of Al and Mg, the particles being present in the sheet in a dispersed state, the average size of the particles of the intermetallic compound being 0.5 μm or less, the percentage of the total area of the particles of the intermetallic compound being more than 0% to 11% in a cross section of the sheet, and a circularity coefficient of the particles of the intermetallic compound is 0.86 or more and 1.05 or less; and an oxide film which extends substantially over the surface of the sheet and which has a uniform thickness.

2. The magnesium alloy sheet according to claim 1, wherein in a cross section of the sheet subjected to saltwater corrosion testing, the uniformity defined as the proportion $t_{max}/t_{min}$ is 1 to 30, where $t_{max}$ is the maximum thickness of the oxide film, which is present on the surface of the sheet, and $t_{min}$ is the minimum thickness thereof.

3. The magnesium alloy sheet according to claim 1, wherein corrosion reaction resistance due to alternating-current impedance after subjecting the sheet to saltwater corrosion testing is greater than corrosion reaction resistance due to alternating-current impedance before subjecting the sheet to the saltwater corrosion testing.

4. The magnesium alloy sheet according to claim 1, wherein in a cross section of the sheet, the number of the particles of the intermetallic compound is 0.1 or more per square micrometer.

5. The magnesium alloy sheet according to claim 1, wherein the maximum size of pores present in the sheet is 5 μm or less.

6. The magnesium alloy sheet according to claim 1, wherein the sheet contains more than 7.5% to 12% by mass Al.

7. The magnesium alloy sheet according to claim 1, further comprising a corrosion layer formed on the surface of the sheet after subjecting the sheet to saltwater corrosion testing, wherein the corrosion layer has an oxide film region and a high-Al concentration region.

8. A magnesium alloy structural member obtained by subjecting the magnesium alloy sheet according to claim 1 to plastic forming.

9. The magnesium alloy sheet according to claim 1, wherein an average distance between particles of the intermetallic compound is 0.52 μm or more and 1.05 μm or less.

* * * * *